US005603620A

United States Patent [19]

Hinze et al.

[11] Patent Number: 5,603,620

[45] Date of Patent: Feb. 18, 1997

[54] INTEGRATED PRINTED CIRCUIT CONNECTOR AND GROUND CLIP ASSEMBLY

[75] Inventors: Lee R. Hinze; Eric J. Thomas, both of Kokomo, Ind.

[73] Assignee: Delco Electronics Corp., Kokomo, Ind.

[21] Appl. No.: 511,423

[22] Filed: Aug. 4, 1995

[51] Int. Cl.[6] ..... H01R 4/66

[52] U.S. Cl. ..... 439/95; 361/816

[58] Field of Search ..... 439/95, 63, 78, 439/350; 361/818, 817, 737

[56] References Cited

U.S. PATENT DOCUMENTS

| | | | |
|---|---|---|---|
| 4,951,158 | 8/1990 | Nakagawa | 439/96 |
| 4,951,176 | 8/1990 | Bergfried et al. | 361/400 |
| 5,083,926 | 1/1992 | Kissinger et al. | 439/78 |
| 5,104,325 | 4/1992 | Mitani et al. | 439/63 |
| 5,138,116 | 8/1992 | Kabayama | 174/138 |
| 5,138,529 | 8/1992 | Colton et al. | 439/95 |
| 5,170,012 | 12/1992 | Braconier | 174/52.3 |
| 5,267,125 | 11/1993 | Liu | 439/95 |

*Primary Examiner*—P. Austin Bradley
*Assistant Examiner*—Eugene G. Byrd
*Attorney, Agent, or Firm*—Mark A. Navarre

[57] ABSTRACT

A U-shaped ground clip and I/O pins are attached to a connector or header of a printed circuit board. The clip has leads which extend into the circuit board for connection to a ground plane and a spring portion which is biased against a metal case to afford a ground connection. The header securely positions the clip during soldering to assure a proper final configuration and to add stiffness to the clip to insure adequate force against the case.

3 Claims, 1 Drawing Sheet

INTEGRATED PRINTED CIRCUIT CONNECTOR AND GROUND CLIP ASSEMBLY

FIELD OF THE INVENTION

This invention relates to the grounding of printed circuit boards in a housing and particularly to a circuit board connector containing a ground clip and to an assembly including such a connector.

BACKGROUND OF THE INVENTION

In some circuit assemblies a circuit board with its associated components is housed within a metal case and the board has a ground plane electrically connected to the case. Previously grounding was done by a screw which is also used to secure the circuit board to the case. The underside of the screw head intimately contacts a plated through hole in the circuit board which was connected to the ground plane. The threads of the fastener mated with the case to complete the grounding circuit. Commonly circuit assemblies achieve circuit communication with external devices through a connector or header on the circuit board which has a body fastened to the circuit board, the body holding an array of pins which are soldered at one end to circuits on the board and are arranged at the other end for coupling to a mating female connector.

It is considered to be desirable to eliminate fasteners in such assemblies so that another approach to grounding the circuit board is needed. If a ground clip were mounted on the board with leads extending through holes in the board like other sticklead components (conventional components with leads) at least three leads would be required for stable mounting, and even then it would be difficult to assure the clip remained in a operative position during the soldering operation. The ground clip must be held in position accurately so that it is in the correct position when the board is installed in the housing to achieve proper grounding. Without the proper support, sticklead components come through a wave soldering process tilted to one side or another with a random and undefined magnitude of misalignment. Thus a secure mount for a ground clip is needed to maintain its position throughout the wave soldering as well as to provide adequate structural stiffness after it is assembled in a housing.

SUMMARY OF THE INVENTION

It is therefore an object of the invention to securely ground a circuit board to a case without the use of fasteners. Another object is to secure a ground clip for fastening to a circuit board.

A circuit board header or connector has a plastic body containing many pins for I/O connections, a slot at one end to receive a ground clip and posts for attachment to the circuit board. A U-shaped sheet metal clip of resilient springy metal has a straight leg portion with one or more leads or projections extending from the end of the leg, and a free leg which extends outwardly from the straight leg. The straight leg is inserted in the slot. The connector is attached to the board with the leads and the I/O pins positioned in circuit board holes for soldering. After soldering, the circuit board is assembled into a metal housing such that the free leg of the grounding clip is biased against the housing to make a ground connection, thereby grounding the circuit to which the clip is soldered. The connector, which is firmly attached to the circuit board securely holds the clip in the correct position during soldering and properly supports the clip to hold it against the housing.

BRIEF DESCRIPTION OF THE DRAWINGS

The above and other advantages of the invention will become more apparent from the following description taken in conjunction with the accompanying drawings wherein like references refer to like parts and wherein.

DESCRIPTION OF THE INVENTION

Figure 1:
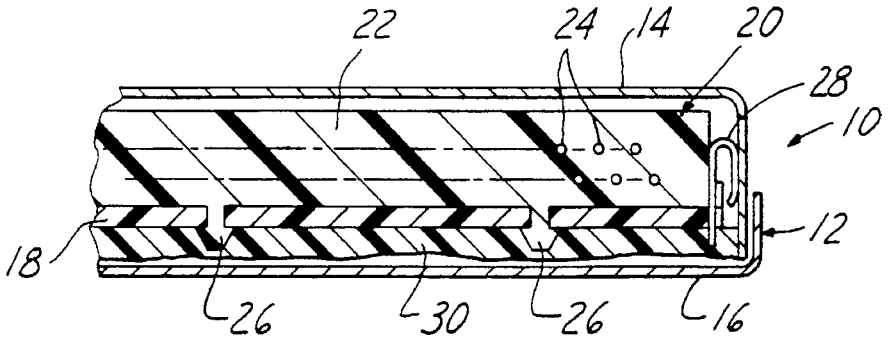
FIG. 1 is a partial cross section of a circuit board, connector and housing assembly with a ground clip according to the invention.

Referring to the drawings, a circuit assembly 10 has a metal housing 12 including a case 14 and a cover 16. A circuit board 18 carrying circuit paths 17 and a ground plane or conductor 19 is mounted in the case. The circuit board supports a connector or header 20 which includes a plastic body 22 and an array of L-shaped I/O pins 24 of conventional design which are pressed through preformed aperture in the body. Each pin 24 has an-inner portion normal to the board for connection to the circuit paths 17 and an outer portion parallel to the circuit board which extends through the body to mate with a female connector. The body also includes posts 26 for attachment to the circuit board and a slot for receiving a ground clip 28. Potting compound 30 covers the lower surface of the circuit board. The clip 28 connects at one end to the ground path 19 and is shown with the other end extending laterally from the end of the connector to engage a side wall of the housing 12, but may instead be placed to extend a different direction to the top or the front wall of the housing, for example, and shaped to suit the application.

Figure 2:
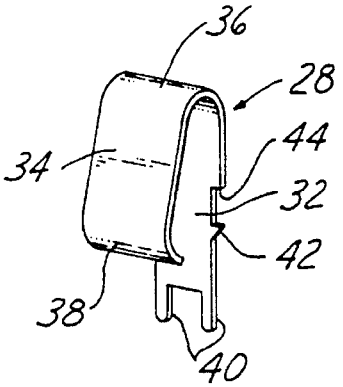
FIG. 2 is an isometric view of the ground clip of FIG. 1.
Figure 4:
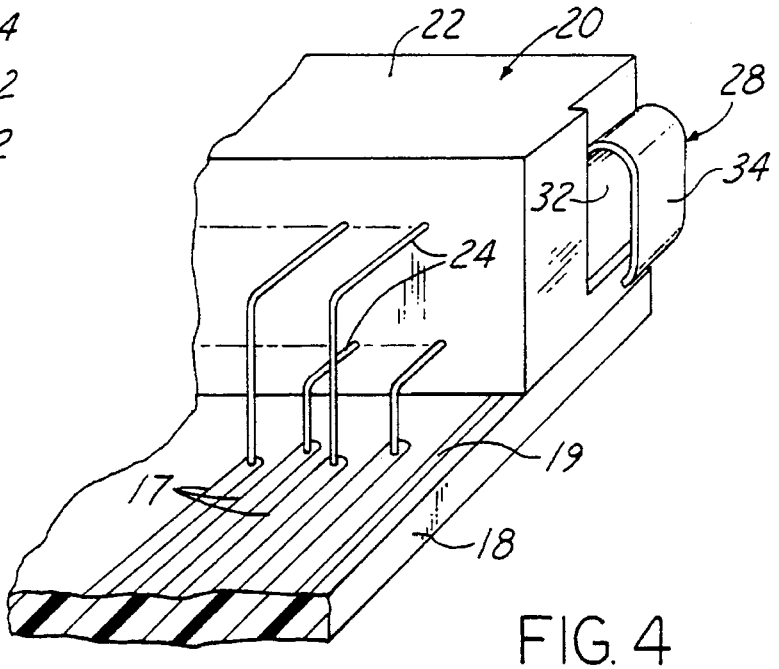
FIG. 4 is a partial isometric view of a circuit board and a connector with a ground clip according to the invention.
Figure 3:
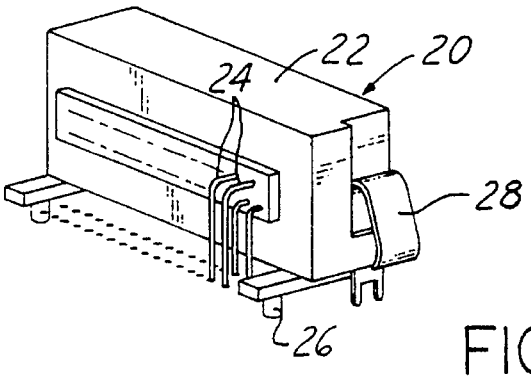
FIG. 3 is an isometric view of a printed circuit connector according to the invention.

The clip 28 is formed from a sheet of spring material such as phosphor bronze. As best shown in FIG. 2, it is generally U-shaped and has a straight leg 32 which extends through the slot in the connector 20 and another leg 34 which slants outwardly from the bight 36 of the U and terminates in a curved-in tip 38 which presents a convex surface for engaging the housing. The leg 32 terminates in a pair of projections 40 which comprise leads for connection to the ground path 19 of the circuit board. One such projection 40 or more than two may be provided. The straight leg 32 includes a barb 42 laterally extending from each side to engage the slot in the body to hold the clip against withdrawal. A shoulder 44 on the leg 32 forms a stop to limit the extent of insertion into the connector.

The circuit assembly is fabricated by molding the connector body with preformed holes for the I/O pins and a slot for the ground clip. The pins and clip are inserted into the body and the posts of the body are inserted into mounting holes in the circuit board and at the same time the pins and clip projections are inserted into corresponding holes in the circuit board. Alternatively, the clip can be inserted into the body and the circuit board after the pins and the body are assembled to the board. A wave soldering method is used to complete the connections of the pins and clip to the circuit paths on the board. The connector holds the clip in the desired attitude throughout the soldering operation and continues to support the clip for added strength upon assembly. The combined connector and circuit board are loaded into the case such that the free leg of the clip presses into conductive engagement with the wall of the case. Since the clip is resilient, the leg is spring biased against the case. Then the exposed surface of the board may be potted with an epoxy compound and the cover applied.

It will thus be seen that the circuit assembly and the grounding clip construction affords a reliable yet inexpensive arrangement for the grounding of a circuit conductor to a case. Various details may be changed from those depicted to suit the configuration of a particular assembly, while retaining the principle features of integrating the ground clip with the connector in order to hold the clip in correct position during the soldering process and to support the clip upon assembly to assure an electrical connection between the case and the conductor.

We claim:

1. A circuit assembly comprising:

a printed circuit board having conductive signal and ground traces printed thereon;

a conductive housing encasing said printed circuit board; and a connector captured in an opening formed in a side face of said housing, said connector including a non-conductive body portion extending through said side face and attached to said printed circuit board at a point adjacent to the housing by mounting posts protruding from said body portion, connector pins passing through the body portion and connected at one end to said conductive signal traces on said circuit board, and a conductive ground clip for electrically coupling said conductive housing to said conductive ground trace, said clip having a stem which is received in a recess formed on a peripheral face of said body portion in the plane of said side face, a terminal portion of said stem attached to said conductive ground trace so as to electrically couple said ground clip to said ground trace, and a resilient contact portion extending from said body portion toward said side face of said housing, said contact portion being compressed between said side face and said body portion to electrically couple said housing to said ground clip.

2. The invention as defined in claim 1 wherein said terminal portion of said ground clip stem is attached to said ground trace by a solder connection.

3. The invention as defined in claim 1 wherein the ground clip comprises a formed metal strip and has a medial portion extending through an opening in said body portion adjacent said recess, and a plurality of leads at said terminal portion of said stem for connection to said ground trace.

* * * * *